US006042981A

United States Patent [19]

Barbetta et al.

[11] Patent Number: 6,042,981

[45] **Date of Patent: *Mar. 28, 2000**

[54] COATED CARRIER

[75] Inventors: Angelo J. Barbetta, Penfield; Robert D. Bayley, Fairport; Carol A. Fox, Canandaigua; Thomas R. Hoffend, Webster; Scott M. Silence, Fairport; K. Derek Henderson, Rochester; John G. VanDusen, Walworth, all of N.Y.

[73] Assignee: Xerox Corporation, Stamford, Conn.

[ * ] Notice: This patent is subject to a terminal disclaimer.

[21] Appl. No.: 09/140,524

[22] Filed: Aug. 26, 1998

[51] Int. Cl.[7] ..... G03G 9/113

[52] U.S. Cl. ..... 430/106.6; 430/108

[58] Field of Search ..... 430/108, 106.6

[56] References Cited

U.S. PATENT DOCUMENTS

| | | | |
|---|---|---|---|
| 3,533,835 | 10/1970 | Hagenbach et al. | 117/217 |
| 3,590,000 | 6/1971 | Palermiti et al. | 252/62.1 |
| 3,658,500 | 4/1972 | Hagenbach | 65/21 |
| 3,798,167 | 3/1974 | Kukla et al. | 252/62.1 |
| 3,918,968 | 11/1975 | Kukla et al. | 96/1.5 D |
| 3,922,382 | 11/1975 | Kukla et al. | 427/58 |
| 3,939,086 | 2/1976 | Hagenbach | 252/62.1 P |
| 4,020,192 | 4/1977 | Nozaki et al. | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,298,672 | 11/1981 | Lu | 430/108 |
| 4,310,611 | 1/1982 | Miskinis | 430/107 |
| 4,338,390 | 7/1982 | Lu | 430/106 |
| 4,397,935 | 8/1983 | Ciccarelli et al. | 430/110 |
| 4,434,220 | 2/1984 | Abbott et al. | 430/108 |
| 4,560,635 | 12/1985 | Hoffend et al. | 430/106.6 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |
| 5,346,791 | 9/1994 | Ozawa et al. | 430/108 |
| 5,376,494 | 12/1994 | Mahabadi et al. | 430/137 |

FOREIGN PATENT DOCUMENTS

| | | |
|---|---|---|
| 63-226661 | 9/1988 | Japan . |
| 10-73968 | 3/1998 | Japan . |
| 10-161356 | 6/1998 | Japan . |

OTHER PUBLICATIONS

Chemical Abstracts 129:128945, Jun. 1998.
Chemical Abstracts 128:302077, Mar. 1998.
Chemical Abstracts 110:222557, Sep. 1988.

*Primary Examiner*—Christopher D. Rodee
*Attorney, Agent, or Firm*—E. O. Palazzo

[57] ABSTRACT

A composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate.

20 Claims, No Drawings

COATED CARRIER

PENDING APPLICATIONS AND PATENTS

Illustrated in U.S. Pat. No. 5,945,244; U.S. Ser. No. 09/140,594; U.S. Ser. No. 09/140,439; and U.S. Pat. No. 5,935,750; all filed concurrently herewith, and the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in copending application U.S. Ser. No. 09/140,594 a carrier comprised of a core and thereover a polymer or polymers of (1) methylmethacrylate and a monoalkyl aminoalkyl methacrylate, or (2) a polymer or polymers of methylmethacrylate and dialkylaminoalkyl methacrylate; in copending application U.S. Ser. No. 09/140,439 a carrier comprised of a core and a polymer coating of (1) styrene/monoalkylaminoalkyl methacrylate or (2) styrene/dialkylaminoalkyl methacrylate; and in U.S. Pat. No. 5,935,750 a carrier comprised of a core and a polymer coating containing a quaternary ammonium salt functionality.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions comprised of a core and thereover terpolymers of (1) styrene/alkyl methacrylate/monoalkyl hydrogen aminoalkyl methacrylate, or (2) styrene/dialkyl aminoalkyl methacrylate.

In embodiments of the present invention, the carrier particles can be comprised of a core with a coating thereover of terpolymers of styrene, n-butyl methacrylate and dimethylaminoethyl methacrylate; terpolymers with styrene/n-butyl methacrylate/dialkyl aminoethyl methacrylate where dialkyl is dimethyl, diethyl, diisopropyl, di-n-butyl, di-n-hexyl, and the like, terpolymers 1s with styrene/n-butyl methacrylate/monoalkyl hydrogen aminoethyl methacrylate where monoalkyl is t-butyl, like t-butylaminoethyl methacrylate, and the like. The carrier may include the polymer coating thereover in admixture with other suitable polymers, and more specifically, with a second polymer, such as a fluoropolymer, polymethylmethacrylate, poly(urethane), especially a crosslinked polyurethane, such as a poly(urethane)polyester and the like, and moreover, the polymer coating may contain a conductive component, such as carbon black, and which conductive component is preferably dispersed in the copolymer coating. With the conductive component there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. An important advantage associated with the carriers of the present include a high triboelectrical charge, for example a carrier tribo range of from about a plus (positive charge) 50 to about 150, or to about 95 microcoulombs per gram, and preferably from about a positive 55 to about a positive 90 microcoulombs per gram, and most preferably from a positive about 60 to a positive about 70 microcoulombs per gram. The carrier particles of the present invention can be selected for a number of different xerographic copiers and printers, such as high speed color xerographic copies, printers, digital copiers, and more specifically, wherein colored copies with excellent and substantially no background deposits are achievable in copiers, printers, digital copiers, and the combination of xerographic copiers and digital systems. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core and the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith.

Carrier particles for use in the development of electrostatic latent images are described in many patents including, for example, U.S. Pat. No. 3,590,000. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where part of, or the entire coating may separate from the carrier core in the form of chips or flakes, and fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low tribo as compared to the high tribo carriers of the present invention.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The present invention has the advantage over this prior art of for example achieving in embodiments the combination of high positive triboelectric charge on the carrier particles, that is, high negative triboelectric charge is imparted to the toner particles developed onto a photoreceptor in, for example, a xerographic development environment, and a range of electrical properties of the carrier particles can be achieved at high triboelectric charging values, for example, from carrier conductivities of $10^{-17}$ mho/cm to $10^{-6}$ mho/cm, that is, from the insulative to the conductive regime.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high triboelectric charging values with finely divided toner particles; and also wherein the carrier particles in embodiments are of substantially constant conductivity.

When resin coated carrier particles are prepared by powder coating process the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities of from about $10^{6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of from a positive triboelectric charge of positive about 20 to a positive of about 150, and for example from a positive about 45 to a positive about 90, microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles and having contained therein conductive particles of, for example, carbon black.

Other U.S. Patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. No. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing a polymer, or polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values of at least about 50 microcoulombs per gram, and wherein the carrier includes thereover a terpolymer, or a coating of two polymers of, for example, a first polymer of a terpolymer of styrene, an alkylmethacrylate or acrylate and a monoalkyl or dialkylaminoalkyl methacrylate, and a second polymer of a fluorocarbon, a styrene polymer, or a poly(urethane), and wherein the coating may contain therein a conductive component of, for example, carbon black.

Aspects of the present invention include a composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; a composition wherein said alkyl of the methacrylate contains from 1 to about 25 carbon atoms; a composition wherein alkyl contains from 1 to about 6 carbon atoms, and said methacrylate is a butyl methacrylate; a composition wherein said polymer is a terpolymer of styrene, n-butyl methacrylate, and dimethylaminoethyl methacrylate; a composition wherein the polymer is a terpolymer of styrene, n-butyl methacrylate and diethylaminoethyl methacrylate, a terpolymer of styrene, n-butyl methacrylate and diisopropyl aminoethyl methacrylate, a terpolymer of styrene, n-butyl methacrylate and t-butyl aminoethyl methacrylate, a terpolymer of styrene, ethyl methacrylate and diisopropyl aminoethyl methacrylate, or a terpolymer of styrene, n-tetradecyl acrylate and diisopropyl aminoethyl methacrylate; a carrier comprised of a core and at least one coating, and which coating is selected from the group consisting of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, (4) polystyrene/alkyl acrylate/alkyl hydrogen aminoethyl methacrylate, or a mixture thereof; a carrier wherein the coating (1) contains from about 50 to about 80 weight percent of styrene, from about 10 to about 40 weight percent of methacrylate or acrylate and from, about 5 to about 30 weight percent of said mono or dialkylaminoalkyl methacrylate; and wherein for the coating, (2) the weight percent of polystyrene is from about 35 to about 80, and the weight percent of methacrylate or acrylate is from about 30 to about 60; a carrier wherein polymer coating (1), (2), (3), or (4) is of an $M_w$, of from about 20,000 to about 900,000, and of an $M_n$ of from about 12,000 to about 350,000; a carrier wherein the coating weight is from about 0.1 to about 20 weight percent; a carrier wherein the coating weight is from about 1 to about 3 weight percent; a carrier wherein the coating terpolymer contains a conductive component; a carrier wherein the conductive component is a metal oxide, carbon black, or mixtures thereof; a carrier wherein said conductive component is carbon black selected in an amount of from about 10 to about 60 weight percent; a carrier wherein said core is a metal, a metal oxide, or a ferrite; a carrier with a triboelectric charge of from about a positive 50 to about a positive 95 microcoulombs per gram, or with a triboelectric charge of from about a positive 60 to about a positive 70 microcoulombs per gram; a developer comprised of the carrier and toner; a developer wherein the toner is comprised of thermoplastic resin and colorant; a developer wherein the colorant is a pigment, or a dye; a developer wherein the resin is a styrene polymer, or a polyester; a developer comprised of a (1) carrier core and a coating of a terpolymer of polystyrene/alkyl methacrylate/dialkylaminoethyl methacrylate, polystyrene/alkyl methacrylate/alkyl hydrogen aminoethyl methacrylate, polystyrene/alkyl acrylate/dialkylaminoethyl methacrylate, or polystyrene/alkyl acrylate/alkyl hydrogen aminoethyl methacrylate, and (2) a toner; a developer wherein the carrier core is selected from the group consisting of iron, ferrites, steel and nickel; a developer wherein methacrylate is n-butyl methacrylate, and said dialkylaminoalkyl methacrylate is diisopropyl aminoethyl methacrylate; a developer with a carrier triboelectric charge of from about a positive 50 to about a positive 75 microcoulombs per gram, and a toner triboelectric charge of from about a negative 50 to about a negative 75 microcoulombs per gram, or with a carrier triboelectric charge of from about a positive 60 to about a positive 70 microcoulombs per gram and a toner triboelectric charge of from about a negative 60 to about a negative 70 microcoulombs per gram; a carrier further including a second polymer; a carrier wherein the second polymer is a fluoro polymer, or a styrene polymer; a carrier wherein the second polymer is a styrene acrylate, a styrene methacrylate, a siloxane, a silicone, or a polyurethane/polyester; a carrier comprised of a coating of (1) polystyrene/alkylmethacrylate/alkylaminoalkyl methacrylate; (2) polystyrene/alkylmethacrylate/alkylhydrogenaminoalkyl methacrylate; (3) polystyrene/alkylacrylate/alkylaminoalkyl methacrylate; or (4) polystyrene/alkylacrylate/alkylhydrogenaminoalkyl methacrylate; a carrier wherein the coating is comprised of a polymer, polymers, or mixtures of polymers of (1), (2), (3) and (4); carrier wherein alkyl contains from 1 to about 25 carbon atoms; and wherein the carrier particles selected can be prepared by mixing low density porous magnetic, or magnetically attractable metal core carrier particles with from, for example, between about 0.05 percent and about 3 percent by weight, based on the weight of the coated carrier particles, of certain polymers and which polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter; a carrier comprised of a core, and thereover a terpolymer of (1), (2), (3) or (4) present in an amount of, for example, from about 0.05 to about 5 weight percent of the total carrier composition, and which carrier terpolymer may optionally contain a conductive component, such as a metal oxide, or a pigment, preferably a conductive carbon black, wherein the conductive component is selected in an amount of, for example, from about 10 to about 75 weight percent, and preferably from about 15 to 50 weight percent, based on the sum of the nitrogen containing polymer and conductive component; a carrier with two polymers thereover, wherein the first polymer is a terpolymer of (1), (2), (3) or (4), and wherein the conductive component for either the first or second polymer is a metal oxide, or a conductive component, such as a conductive carbon black, which component can be selected in an amount of from about 10 to about 50 weight percent; and wherein the second polymer is a known suitable polymer, such as, for example, a fluorocarbon, polymethylmethacrylate (PMMA), a thermosetting polymer such as a thermosetting polyurethane, a polyester, a styrene based polymer, or a second a nitrogen-containing polymer, and wherein the first polymer is selected in an amount of from about 1 to about 100, or from about 10 to about 75 weight percent, based on the total weights of all polymers and conductive components present in the carrier, and the second polymer is selected in an amount of from about 99 to about 0, or from about 90 to about 25 weight percent, based on the total weights of all polymers and conductive components present in the carrier.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and also, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites, such as Cu/Zn-ferrite, containing, for example, about 11 percent copper oxide, 19 percent zinc oxide, and 70 percent iron oxide and available from D.M. Steward Corporation or Powdertech Corporation, Ni/Zn-ferrite available from Powdertech Corporation, Sr (strontium)-ferrite containing, for example, about 14 percent strontium oxide and 86 percent iron oxide and available from Powdertech Corporation and Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of from between about 30 microns to about 200 microns.

Examples of terpolymers selected for the carrier include terpolymers of styrene, n-butyl methacrylate or acrylate and a monoalkyl, or dialkyl amine, such as a dimethylaminoethyl methacrylate, diethylaminoethyl methacrylate, diisopropylaminoethyl methacrylate, or t-butylaminoethyl methacrylate, and the like. Specific examples of terpolymer coatings are poly(styrene/n-butyl methacrylate/tertiary-butylaminoethyl methacrylate), poly(styrene/n-butyl methacrylate/diethylaminoethyl methacrylate), poly (styrene/n-butyl methacrylate/diisopropylaminoethyl methacrylate), terpolymers of styrene/n-butyl methacrylate with other monoalkyl or dialkylaminoethyl methacrylates, wherein alkyl contains independently, for example, from about 1 to about 25, and preferably from 1 to about 10 carbon atoms, such as methyl, ethyl, n-propyl, isopropyl, butyl, pentyl, decyl, pentadecyl, heptadecyl, octadecyl, nonadecyl, eicosyl, pentylcosyl, and the like.

The monomers for synthesizing the above polymers are obtained from Aldrich Chemical Company with regard to styrene, dimethylaminoethyl methacrylate, diethyl aminoethyl methacrylate, 4-vinyl pyridene and methylmethacrylate, and Scientific Polymer Products with regard to diisopropylaminoethyl methacrylate and t-butylaminoethyl methacrylate. Synthetic methods for the preparation of polymers and copolymers from these monomers may be by bulk polymerization, solution polymerization, emulsion polymerization, suspension or semisuspension polymerization, or any other known suitable polymerization methods. The terpolymer can also be prepared by other methods, such as by known solution polymerizations, and the like.

The polymers can, for example, be prepared by bulk polymerization which can be accomplished with monomers in the absence of solvent, and by solution polymerization can be effected in a solvent medium such as toluene in which the monomer or mixture of monomers is combined with a suitable initiator such as 2,2'-azobis(2-methylpropionitrile), refered to as AIBN, and reacted for an effective period of time, for example from about 7 to about 15, and preferably about 11 hours, at an elevated temperature, for example about 65° C. to about 80° C. From this reaction, a solution with a solids content of about 25 to 30 percent by weight polymer can be obtained, in which the polymer has a glass transition temperature of about 60° C. to about 130° C. measured by Differential Scanning Calorimetry, and molecular weight by gel permeation chromatography of $M_w$ about 50,000 to about 700,000 and $M_n$ about 20,000 to about 350,000 with molecular weight dispersibility, that is $M_w/M_n$ or MWD about 1.6 to about 3.0.

The suspension polymerization method involves mixing monomers, such as styrene, n-butyl methacrylate and diisopropylaminoethyl methacrylate and initiator, such as AIBN, to obtain a clear organic phase. The organic phase is then combined with an aqueous solution of Air Products Airvol 603 Polyvinyl Alcohol, and potassium iodide aqueous phase inhibitor. The desired particle size is obtained by homogenizing the two phases with a Brinkman homogenizer equipped with a Polytron Generator with three stationary and three moving rings of flat rotor design for five minutes at about 8,000 RPM. The resulting suspended organic phase is then transferred to the preheated reactor and stirred at about 65 to 125 RPM to maintain stability of the suspension. The suspension is then maintained at 70° C. for 6 hours and 40 minutes to complete polymerization. The polymer suspension is then cooled, removed from the reactor, washed and centrifuged 5 times with a 10/90 volume ratio of methanol/water and finally washed with water only. The wet polymer suspension is then air dried, placed in a vacuum oven at from about 40.0° C. to 80.0° C. to complete drying, and further broken down to its primary particle size by ball milling followed by screen sieving. Alternatively the washed particles can also be recovered by freeze drying. This process yields a polymer particle size having a volume median of about 4.0 $\mu$, a second pass glass transition onset temperature of 58.6° C., and a molecular weight by gel permeation chromatography of about $M_w$=58,000 with molecular weight distribution of about 2.2.

Emulsion polymerization is accomplished by the continuous addition to a suitable reaction vessel containing water, and providing mechanical stirring, nitrogen atmosphere, and thermostatic control, a mixture of monomers of for example styrene, n-butyl methacrylate and diisopropylaminoethyl methacrylate and an initiator, such as ammonium persulfate initiator, as obtained from the Aldrich Chemical Company (0.2 to 0.6 percent, by weight of monomers). The polymerization effected by heating to, for example, between about 55 and about 65° C. to achieve molecular weights, $M_w$ by gel permeation chromatography ranging from, for example, about 200,000 to about 500,000. The polymer or copolymer powder is isolated by freeze drying in vacuo, the residue free latex. The resulting polymer particle diameter size is, for example, 0.1 to 2.0 microns in volume average diameter.

The polymer coating preferably has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxy phenyl)azo]-3-(mono-substituted)-2-naphthalenolato(2-)] chromate(1-), ammonium sodium and hydrogen (TRH), cetyl pyridinium chloride (CPC), FANAL PINK®D4830, and the like, including those as specifically illustrated herein, and other effective known charge agents or additives. The charge additives are selected in various effective amounts, such as from about 0.05 to about 15, and from about 0.1 to about 3weight percent, based on the sum of the weights of all polymer, conductive additive, and charge additive components. The addition of various known charge enhancing additives can act to further increase the triboelectric charge, such as positive charge imparted to the carrier, and therefore, there can be a further increase in the negative triboelectric charge imparted to the toner in, for example, a xerographic development subsystem.

Examples of second polymers selected can include poly alkyl or methacrylates or acrylates, polyurethanes, fluorocarbon polymers, such as polyvinylidenefluoride, polyvinylfluoride, and polypentafluorostyrene, polyethylene, polyethylene-co-vinylacetate, polyvinylidenefluoride-co-tetrafluoroethylene, and the like. Other known related polymers not specifically mentioned herein may also be selected, such as those illustrated in the U.S. Pat. Nos. 4,937,166 and 4,935,326 patents mentioned herein.

Another second polymer is comprised of a thermosetting polymer, more specifically a poly(urethane) thermosetting resin which contains, for example, from about 75 to about 95, and preferably about 80 percent by weight of a polyester polymer, which, when combined with an appropriate crosslinking agent such as isopherone diisocyanate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

The advantages of the carriers of the present invention include in embodiments high robust carrier tribo charge of a positive value, high toner tribo charge of a negative value, excellent admix, for example from about 1 to about 30 seconds as determined in the charge spectrograph, and more specifically, the toner tribo of from about a minus 50 to about a minus 150, from about a minus 55 to about a minus 90, or from about a minus 60 to about a minus 85, with corresponding positive tribo charge for the carrier.

Other advantages of the present invention include increased resistance of the carrier to mechanical aging in a xerographic environment and a decreased sensitivity of the carrier triboelectric value to the relative humidity of the environment. With respect to high toner tribo charge of a negative value, this property is important to xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

Various effective suitable processes can be selected to apply the polymer, or mixture, for example from 2 to about 5, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about 10–17 mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of, for example, from about 1 percent by weight to about 20, and preferably from about 5 to about 12 percent by weight, based on the total weight of the toner components, however, lesser or greater amounts of pigment may be selected. Colorants include dyes, pigments, mixtures thereof, mixtures of dyes, mixtures of pigments, and the like.

When the colorant particles are comprised of magnetites, which are a mixture of iron oxides ($FeO \cdot Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like can be selected. These colorants, especially pigments are generally present in the toner composition in an amount of from about 1 weight percent to about 15, and for example, from about 2 to about 12 weight percent based on the weight of the toner components of binder and pigment.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Toner particles sizes and shapes are known and include for example a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with this developer composition possess, for example, acceptable solids, excellent halftones, and desirable line resolution with acceptable or substantially no background deposits excellent chroma, superior color intensity, constant color chroma and intensity over extended time periods, such as 1,000,000 imaging cycles, and the like.

The following Examples are being provided to further illustrate the present invention, it being noted that these Examples are intended to illustrate and not limit the scope of the present invention. Parts and percentages are by weight unless otherwise indicated.

SYNTHETIC EXAMPLE I

Synthesis of a 65.0/32.2/2.8 weight percent of the terpolymer, poly(styrene-co-n-butylmethacrylate-co-dimethylaminoethyl methacrylate) as follows:

A 2.5 liter jacketed glass reactor was fitted with a stainless steel stirrer, a thermal couple temperature probe, a water cooled condenser with nitrogen outlet, a nitrogen inlet, and heated with hot, about 75° C., water circulating bath. Toluene and monomers of styrene, n-butyl methacrylate and dimethylaminoethyl methacrylate were passed through a column of basic aluminum oxide to remove inhibitors and sparged with nitrogen gas to remove oxygen. The polymerization initiator 2,2'-azobis(2-methylpropionitrile), referred to as AIBN, was used as received.

To a suitable mixing vessel was added: 750.0 grams of the above reagent grade toluene, 14.0 grams of dimethylaminoethyl methacrylate, 161.0 grams of n-butylmethyl methacrylate, 325.0 grams of styrene, and 2.0 grams of AIBN. After a solution was obtained, the contents were transferred to the glass reactor that was preheated to maintain a 70° C.+/−1.0° C. polymerization temperature. After 8.0 hours of polymerization, a second addition of 1.0 gram of AIBN, dissolved in 100.0 grams of toluene was accomplished and the mixture was then polymerized for 8.0 hours more. A third addition of 1.0 gram of AIBN dissolved in 100.0 grams of toluene was then accomplished and the mixture was then polymerized for an additional 8.0 hours to complete the monomer conversions. The polymer solution resulting was cooled and transferred to a glass storage vessel using additional toluene to rinse out the polymer solution in the reactor. Upon characterization, the solution had a polymer solids content of 23.8 percent by weight polymer, and the polymer glass transition was 58.6° C. Molecular weight of the polymer by gel permeation chromatography was: $M_w$=49,000, $M_n$=28,000, MWD=1.75.

CARRIER EXAMPLE I

In the first step of the solution coating process, 22.7 grams of a terpolymer of poly(styrene-co-n-butylmethacrylate-co-dimethylaminoethyl methacrylate) in a 65.0/32.2/2.8 weight percent monomer ratio are dissolved in 90.8 grams of toluene by a roll mill until the polymer is adequately dissolved. The terpolymer solids concentration is about 20 percent by weight. The dissolved polymer in the solvent is known as the "lacquer". In the second step of the solution coating process, 2,270 grams of a spherical steel core with a volume median diameter of 100 microns (Nuclear Metals, Inc.) is added to a Vibratub and heated by a heat gun to 176° F. The Vibratub is turned on to begin vibration, and the lacquer is then slowly added to the hot core and the solvent flashes off. Subsequently, the core and lacquer are agitated by the vibration generated from the Vibratub, spatulas and other tools to remove the residual solvent. The product was then spread out on an aluminum tray and vacuum dried for several hours. The product was then screened through an 84 TBC (Tensile Bolt Cloth) mesh screen to remove any large agglomerates. The final product was comprised of a spherical steel carrier core, 100 microns in diameter, with a total of 1.0 percent by weight of the terpolymer poly(styrene-co-n-butylmethacrylate-co-dimethylaminoethyl methacrylate) in a 65.0132.212.8 weight percent monomer ratio on the surface of the carrier.

A developer composition was then prepared by mixing 200 grams of the above prepared carrier with 10 grams of a toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer and REGAL 330® carbon black, about 10 weight percent. Thereafter, the triboelectric charge on the carrier particles was determined by the known Faraday Cage process, and there was measured on the carrier a charge of 27.9 microcoulombs per gram. Further, the conductivity of the carrier as determined by forming a 0.1 inch long magnetic brush of the carrier particles, and measuring the conductivity by imposing a 10 volt potential across the brush was too insulating to be measured ($>10_{-15}$ mho-cm$_{-1}$). Therefore, these carrier particles were insulative.

For comparison, a carrier generated under the same conditions as above comprising a carrier core with a total of 1.0 percent by weight poly(styrene-co-n-butylmethacrylate) polymer, with a monomer ratio of 58 percent styrene and 42 percent n-butylmethacrylate, on the surface and blended into a developer composition under the same conditions as above yields a positive measured triboelectric charge on the carrier of 8.1 microcoulombs per gram of toner.

CARRIER EXAMPLE II

In the first step of the solution coating process, 22.7 grams of a terpolymer synthesized in the manner described in Synthetic Example I and composed of poly(styrene-co-n-butylmethacrylate-co-dimethylaminoethyl methacrylate) in a 53.5/26.5/20 weight percent monomer ratio were dissolved in 90.8 grams of toluene via roll milling until the polymer was adequately dissolved. The terpolymer solids concentration was about 20 percent by weight. The coating process was substantially identical to that of Carrier Example I. The final product was comprised of a steel carrier core with a total of 1.0 percent by weight of a terpolymer of poly (styrene-co-n-buytylmethacrylate-co-dimethylaminoethylmethacrylate) in a 53.5/26.5/20 weight percent monomer ratio on the surface of the carrier.

A developer composition was then prepared by repeating the process of Carrier Example I. Thereafter, the triboelectric charge on the carrier particles was determined by the known Faraday Cage process, and it was believed that a high triboelectric value would be obtained, based on the measured difference between the triboelectric values of the carrier in Carrier Example I and that of the comparative Example in Carrier Example I, in conjunction with the increase in dimethylaminoethyl methacrylate concentration. Specifically, it was believed that a triboelectric value of between 90 and 110 microcoulombs per gram will be obtained. Further, it was believed that the conductivity of the carrier, as determined by forming a 0.1 inch long magnetic brush of the carrier particles, and measuring the conductivity by imposing a 10 volt potential across the brush, would be too insulating to be measured ($>10_{-15}$ mho-cm$^{-1}$). Therefore, these carrier particles were insulative. Additional adjustments to the dimethylaminoethyl methacrylate concentration, specifically to values intermediate to the 2.8 percent concentration of Carrier Example I and the 20 percent concentration of the current Example, were believed to yield triboelectric values of various magnitudes between, for example, about 27 to about 110 microcoulombs per gram.

Other embodiments and modifications of the present invention may occur to those of ordinary skill in the art subsequent to a review of the present application and the information presented herein; these embodiments and modifications, as well as equivalents thereof, are also included within the scope of the present invention.

What is claimed is:

1. A carrier comprised of a core and a first coating selected from the group consisting of (1) polystyrene/alkyl methacrylate/dialkylaminoethyl methacrylate, (2)

polystyrene/alkyl methacrylate/alkyl hydrogen aminoethyl methacrylate, (3) polystyrene/alkyl acrylate/dialkylaminoethyl methacrylate, (4) polystyrene/alkyl acrylate/alkyl hydrogen aminoethyl methacrylate, and mixtures thereof, and a second coating of a polyurethane/polyester.

2. A carrier in accordance with claim 1 wherein the first coating (1) contains from about 50 to about 80 weight percent of styrene, from about 10 to about 40 weight percent of alkyl methacrylate and from, about 5 to about 30 weight percent of said dialkylaminoethyl methacrylate; and wherein for the coating, (2) the weight percent of polystyrene is from about 35 to about 80, and the weight percent of alkyl methacrylate is from about 30 to about 60.

3. A carrier in accordance with claim 1 wherein polymer coating (1), (2), (3), or (4) is of an $M_w$ of from about 20,000 to about 900,000, and of an $M_n$ of from about 12,000 to about 350,000.

4. A carrier in accordance with claim 1 wherein the first coating weight is from about 0.1 to about 20 weight percent.

5. A carrier in accordance with claim 1 wherein the first coating weight is from about 1 to about 3 weight percent.

6. A carrier in accordance with claim 1 wherein the first coating terpolymer contains a conductive component.

7. A carrier in accordance with claim 6 wherein the conductive component is a metal oxide, carbon black, or mixtures thereof.

8. A carrier in accordance with claim 7 wherein said conductive component is carbon black selected in an amount of from about 10 to about 60 weight percent.

9. A carrier in accordance with claim 1 wherein said core is a metal, a metal oxide, or a ferrite.

10. A carrier in accordanc e with claim 1 with a triboelectnc charge of from about a positive 50 to about a positive 95 microcoulombs per gram.

11. A developer comprised of the carrier of claim 1 and toner.

12. A developer in accordance with claim 11 wherein the toner is comprised of thermoplastic resin and colorant.

13. A developer in accordance with claim 12 wherein the colorant is a pigment or a dye.

14. A developer in accordance with claim 13 wherein the resin is a styrene polymer or a polyester.

15. A carrier in accordance with claim 6 with a triboelectric charge of from about a positive 60 to about a positive 70 microcoulombs per gram.

16. A developer comprised of a (1) carrier core and a first coating of a terpolymer of polystyrene/alkyl methacrylate/dialkylaminoethyl methacrylate, polystyrene/alkyl methacrylate/alkyl hydrogen aminoethyl methacrylate, polystyrene/alkyl acrylate/dialkylaminoethyl methacrylate, or polystyrene/alkyl acrylate/alkyl hydrogen aminoethyl methacrylate, and a second polymer coating of a siloxane, a silicone, or a polyurethane/polyester, and (2) a toner.

17. A developer in accordance with claim 16 wherein the carrier core is selected from the group consisting of iron, ferrites, steel and nickel.

18. A developer in accordance with claim 16 wherein said alkyl methacrylate is n-butyl methacrylate.

19. A developer in accordance with claim 17 with a carrier triboelectric charge of from about a positive 50 to about a positive 75 microcoulombs per gram, and a toner triboelectric charge of from about a negative 50 to about a negative 75 microcoulombs per gram.

20. A carrier consisting essentially of a core and a first coating selected from the group consisting of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, (4) polystyrene/alkyl acrylate/alkyl hydrogen aminoethyl methacrylate, and mixtures thereof, and a second coating of a polyurethane/polyester.

* * * * *